US005799514A

United States Patent [19]

Tobin, Jr. et al.

[11] Patent Number: 5,799,514

[45] Date of Patent: Sep. 1, 1998

[54] FLUID ACTUATED HANDCUFF

[75] Inventors: Thomas H. Tobin, Jr., Fond Du Lac; Norbert J. Kot, Brookfield, both of Wis.

[73] Assignee: American Handcuff Co., Fond Du Lac, Wis.

[21] Appl. No.: 827,033

[22] Filed: Mar. 25, 1997

[51] Int. Cl.[6] ..... E05B 75/00

[52] U.S. Cl. ..... 70/16; 70/DIG. 48; 70/275

[58] Field of Search ..... 70/14, 19, 275, 70/DIG. 48, 50; 292/252; 128/846, 847, 869, 877–879, 882; 119/720, 820, 856, 857

[56] References Cited

U.S. PATENT DOCUMENTS

| | | | |
|---|---|---|---|
| 46,239 | 2/1865 | Hungerford | 70/403 |
| 542,001 | 7/1895 | Mlotkowski . | |
| 722,258 | 3/1903 | Sines . | |
| 872,650 | 12/1907 | Gilroy | 70/DIG. 48 X |
| 948,853 | 2/1910 | Gilroy . | |
| 1,020,208 | 3/1912 | Laughlin | 70/403 X |
| 1,077,846 | 11/1913 | Mayer | 70/403 X |
| 1,100,417 | 6/1914 | Capitain | 70/408 X |
| 1,209,562 | 12/1916 | Cunningham | 70/408 |
| 1,234,212 | 7/1917 | Renaux | 70/403 |
| 1,364,736 | 1/1921 | Domanski | 70/403 |
| 1,579,333 | 4/1926 | Neal | 70/16 |
| 1,821,566 | 9/1931 | Neal | 70/16 |
| 1,851,206 | 3/1932 | Neal | 70/16 |
| 2,044,381 | 6/1936 | Denull | 70/14 |
| 2,066,393 | 1/1937 | Dials | 70/275 X |
| 2,093,925 | 9/1937 | Pickop | 70/403 |
| 2,298,776 | 10/1942 | Rhein | 70/275 X |
| 2,390,885 | 12/1945 | Kelley | 70/16 |
| 2,759,349 | 8/1956 | McKee | 70/16 |
| 3,524,334 | 8/1970 | Salvesen | 70/275 |
| 3,545,237 | 12/1970 | Thompson et al. | 70/16 |
| 3,580,623 | 5/1971 | Peters | 70/275 X |
| 3,610,004 | 10/1971 | Neese | 70/275 X |
| 4,169,616 | 10/1979 | Peterson | 70/275 X |
| 4,300,368 | 11/1981 | Sullivan | 70/16 |
| 4,314,466 | 2/1982 | Harris | 70/16 |
| 4,461,284 | 7/1984 | Fackler | 128/60 |
| 4,471,595 | 9/1984 | Lanzafame | 52/584 |
| 4,574,600 | 3/1986 | Moffett | 70/16 |
| 4,652,166 | 3/1987 | Gautron | 403/41 |
| 4,697,441 | 10/1987 | Allen | 70/16 |
| 4,726,203 | 2/1988 | Komuro | 70/275 X |
| 4,964,419 | 10/1990 | Karriker | 128/879 |
| 5,003,800 | 4/1991 | Bublewicz | 70/264 |
| 5,177,988 | 1/1993 | Bushnell | 292/252 X |
| 5,463,884 | 11/1995 | Woo et al. | 70/16 |

FOREIGN PATENT DOCUMENTS

| | | | |
|---|---|---|---|
| 4408/31 | 10/1931 | Australia . | |
| 1557916 | 1/1968 | France . | |
| 2 518 622 | 12/1981 | France . | |
| 247666 | 11/1911 | Germany . | |
| 128409 | 11/1928 | Germany . | |
| 6808902 | 12/1969 | Netherlands | 70/16 |
| 2005871 | 1/1994 | Russian Federation . | |
| 17223 | 10/1889 | United Kingdom . | |

*Primary Examiner*—Suzanne Dino

*Attorney, Agent, or Firm*—Ryan, Maki, Mann & Hohenfeldt

[57] ABSTRACT

A handcuff includes a pair of arcuate cuff bow arranged to encircle a human wrist. A locking mechanism on one of the cuff bows releasably engages the other bow to secure the bows around a wrist. A fluid actuated cylinder coupled to the locking mechanism releases the locking mechanism when pressurized fluid, such as air, is applied. The fluid actuated cylinder avoids the use of keys, resulting in a more enclosed structure that is more difficult to pick than prior key-based mechanisms. Use of the fluid actuated cylinder further improves security by making ordinary handcuff keys, which are frequently possessed by or available to prisoners, ineffective to open the handcuffs.

22 Claims, 3 Drawing Sheets

FLUID ACTUATED HANDCUFF

BACKGROUND OF THE INVENTION

This invention relates generally to personal restraints and, more particularly, to handcuffs and legcuffs used in law enforcement.

Handcuffs are well-known devices that are used in a variety of law enforcement applications. Like other pieces of police equipment, handcuffs are subject to sometimes conflicting design considerations. On the one hand, handcuffs, like an officer's service weapon, see infrequent actual use. Most of the time, handcuffs are carried by an officer without actually being put to use. To avoid burdening the officer with unnecessary weight and bulk, handcuffs should be light and compact. On the other hand, when handcuffs are needed to restrain powerful, violent subjects, they need to be strong and reliable. One important goal in handcuff design is to achieve strength and reliability in combination with easy portability.

Not all law enforcement situations involve powerful, violent subjects. Standard police procedures often require the use of handcuffs during all arrests, regardless of how old, young, frail or non-violent the person arrested might be. In such cases, it is desirable to avoid inflicting unnecessary injury on the person taken into custody. This requires that handcuffs be designed to avoid cutting off circulation, lacerating skin or otherwise injuring the arrested person. Strength and reliability can sometimes be at odds with such concerns.

Operating convenience is still another important concern. Handcuffs are often applied as a routine precautionary measure when possible offenders are temporarily detained and questioned without formal arrest. If no arrest is made, the handcuffs are removed at the scene by the law enforcement officers involved. Typically, officers carry handcuff keys with them so as to be able to remove the cuffs themselves if desired. When the same officer who applies the handcuffs removes them, there is little difficulty in ensuring that the key in the officer's possession will operate the handcuffs that are applied.

Frequently, however, handcuffs are applied to a prisoner by one set of law enforcement personnel and are removed by an entirely different set of personnel. This occurs, for example, when prisoners are transferred from one correctional facility to another, or are transported to court for trial or testimony or are transported to an "outside" health care facility. Because handcuffs are frequently applied and removed by different people, it is desirable to use more or less standardized designs that can be unlocked using a single key configuration. This ensures that the facility receiving a prisoner placed in transport will be able to remove the handcuffs using a key they have on hand.

Finally, handcuffs, like other pieces of police gear, need to be purchased in relatively large numbers as new officers come on duty, and as handcuffs are "lost ", for example, by way of prisoners transferred to distant facilities. (Rarely are the handcuffs returned.) Economy is thus a consideration for publicly financed departments that need to operate within limited budgets. Like other pieces of needed equipment, handcuffs, too, need to be capable of economical manufacture and purchase.

Because of these various competing concerns, handcuff designs have been more or less unchanged for decades. The typical handcuff design includes a pair of cuffs that are connected to each other and can be locked around a person's wrists. Each cuff includes a pair of pivotally joined bows that together encircle the person's wrist. Typically, each cuff includes a cheek plate or double bow and a blade or single bow arranged to swing toward and into the double bow. A locking mechanism is located in the double bow functions to resist withdrawing movement of the single bow when the end of the single bow is inserted through the locking mechanism. The locking mechanism allows movement of the single bow into the double bow to enable the handcuffs to be snugged down onto the person's wrist. A simple key can be used to place the locking mechanism in a "double locked" position, wherein movement of the single bow in either direction (i.e., closing or opening movement) is prevented. The key can also be used to place the locking mechanism in an "unlocked " position wherein the single bow can be separated from the double bow to release the handcuffs. Or the handcuffs can be placed in a "single locked" position wherein the single bow can be advanced in a closing direction, but not withdrawn from the double bow. A simple pawl in the locking mechanism engages a ratchet formed in the lower end of the single bow to accomplish the various locking functions. The key simply displaces the pawl away from the ratchet to unlock the handcuffs.

Unlike conventional security locks that are made intentionally complex in order to thwart picking, handcuff locking mechanisms are very simple in design and operation. Furthermore, their keys are very simple, and more or less standard, in design. This helps ensure that different officers and, indeed, officers from different departments can still unlock and release the handcuffs. Similarly, the simple locking mechanism design contributes greatly to manufacturing economy. Unfortunately, these attributes compromise the effectiveness and security of existing handcuff designs, particularly when violent, hardened or otherwise dangerous prisoners are involved. The basic design of handcuff locking mechanisms is well known and of common knowledge among dangerous prisoners. Handcuffs can often be released by sliding a thin metal strip between the pawl and the ratchet of the single bow, particularly if the officer in charge forgets or elects not to place the handcuffs in a double locked position. Conventional handcuffs are also easily picked by knowledgeable prisoners using a paper clip or similar simple tool. Finally, handcuff keys exist in large numbers and are readily available to non-police personnel. Such keys are easily secreted in the body, clothing or personal effects of a prisoner. A need exists, therefore, for improving the security of existing handcuff designs without compromising the substantial benefits of existing designs.

SUMMARY OF THE INVENTION

The invention provides a handcuff that includes a cuff assembly that is shaped and dimensioned to encircle a human wrist and that is movable between an open position and a closed position. The handcuff further includes a fluid-actuated locking mechanism operatively associated with the cuff assembly operable to lock the cuff assembly in the closed position and to unlock the cuff assembly for movement to the open position.

The invention also provides a fluid actuated handcuff including a cuff assembly having a pair of hinged bows shaped and dimensioned to encircle a human wrist and movable relative to each other so as to facilitate placement around a human wrist. The handcuff further includes a locking mechanism associated with one of the bows operable to engage and selectively retain the other of the bows in a closed loop configuration around a human wrist, and an actuator coupled to the locking mechanism operable to release the locking mechanism and thereby permit disengaging movement of the bows relative to each other. The actuator is actuated by means of pressurized fluid applied to the actuator.

The invention also provides a fluid-actuated handcuff including a first arcuate cuff bow having an upper end and a lower end defining a lock mechanism housing, a second arcuate cuff bow having an upper end pivotally joined to the upper end of the first cuff bow and having a lower end movable into the lock mechanism housing, a pawl in the lock mechanism housing mounted for movement toward and away from engagement with the lower end of the second cuff bow, a bias member coupled to the pawl for biasing the pawl toward the lower end of the second cuff bow, a pawl block within the lock mechanism housing movable among a release position wherein the pawl block displaces the pawl away from the lower end of the second cuff bow against the bias of the bias member, a single lock position wherein the pawl is biased by the bias member into engagement with the lower end of the second cuff bow but is free to move away from the lower end of the second cuff bow, and a double lock position wherein the pawl is in engagement with the lower end of the second cuff bow and the pawl block blocks movement of the pawl away from the lower end of the second cuff bow, and a fluid actuator within the lock mechanism housing and coupled to the pawl block operable to move the pawl block among the release, single lock and double lock positions.

The invention also provides a fluid-actuated restraint comprising, a cuff assembly shaped and dimensioned to encircle a human limb and movable between an open position and a closed position, and a fluid-actuated locking mechanism operatively associated with the cuff assembly operable to lock the cuff assembly in the closed position and to unlock the cuff assembly for movement to the open position.

The invention also provides a fluid-actuated restraint system comprising, a cuff assembly shaped and dimensioned to encircle a human limb and movable between an open position and a closed position, a fluid-actuated locking mechanism operatively associated with the cuff assembly operable to lock the cuff assembly in the closed position and to unlock the cuff assembly for movement to the open position, and a release device operable to apply pressurized fluid to the locking mechanism to unlock the cuff assembly.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, wherein like reference numerals identify like elements, and wherein:

DESCRIPTION OF THE PREFERRED EMBODIMENT

Figure 1:
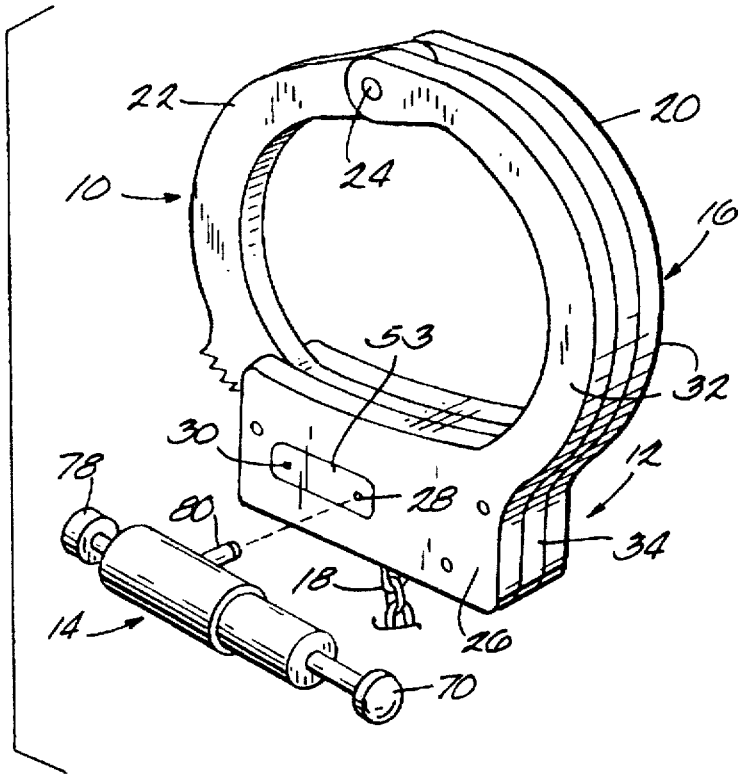
FIG. 1 is a perspective view of a fluid actuated handcuff system including a fluid actuated handcuff and a release device, embodying various features of the invention.

Referring to the drawings, and in particular to FIG. 1, a fluid-actuated handcuff system 10 embodying various features of the invention is illustrated. The system 10 includes a pair of fluid-actuated handcuffs 12 and a release device 14 for releasing the handcuffs 12. The handcuffs 12 comprise a pair of cuff assemblies 16 joined by a chain 18 or other link. Although a single cuff assembly 16 is shown, it will be understood that a pair of such cuff assemblies 16 are included in each pair of handcuffs 12.

Each cuff assembly 16 includes a pair of first and second arcuate handcuff bows 20 and 22 configured to encircle a human wrist. In accordance with standard practice, the first bow 20 comprises a "double bow" made up of two spaced elements. The second bow 22 comprises a single bow or blade. The bows 20 and 22 are pivotally joined to each other at their upper ends by means of a rivet 24 or other such pivot. The lower end of the double bow defines a housing 26 into which the lower end of the single bow 22 swings when the bows 20 and 22 are swung toward each other around the pivot 24. A fluid-actuated locking mechanism in the housing 26 engages and secures the lower end of the single bow 22 within the housing 26 to releasably secure the cuff assembly 16 around a wrist. The locking mechanism, which will be described in greater detail below, provides three different operating positions, namely a "release" position wherein the lower end of the single bow 22 can be withdrawn from the housing 26, a "single lock" position wherein the lower end of the single bow 22 can be pushed further into, but not withdrawn from, the housing 26, and a "double lock" position wherein the lower end of the single bow 22 is fixed and can neither be pushed further into nor withdrawn from the housing 26.

In accordance with one aspect of the invention, the handcuffs 12 are locked and unlocked by means of applied fluid pressure rather than through use of a key. In the illustrated embodiment, the handcuffs 12 are operated by means of pressurized air applied to either of two fluid inlet ports 28, 30 provided in the housing 26. The illustrated release device 14 comprises a hand-actuated pump operable to apply a charge of compressed air to either of the fluid ports 28, 30. When pressurized air is applied to inlet port 30, the locking mechanism is placed in the "release" position, thereby enabling the cuff assembly 16 to be removed. When pressurized air is removed from the inlet port 30, the locking mechanism automatically goes to the "single lock" position wherein the cuff assembly 16 can be further tightened onto the wrist but not loosened. When pressurized air is applied to the other inlet port 28, the locking mechanism is placed in the "double lock" position wherein the cuff assembly 16 is fixed and can neither be tightened nor loosened. Once the locking mechanism is placed in the "double lock" position, it can only be released by applying pressurized air to inlet port 30. The removal of pressure on the inlet port 28 is insufficient, by itself, to move the locking mechanism from the "double lock" position.

As illustrated, the first cuff bow 20 includes a pair of side or cheek plates 32 separated by a spacer plate 34. The lower ends of the cheek plates 32, together with the spacer plate 34, define the housing 26. The upper end of the single cuff bow 22 is pinned between the upper ends of the cheek plates 32 by means of the rivet 24, and the lower end of the single bow 22 swings into the housing between the lower ends of the cheek plates 32. In the illustrated embodiment, the cheek plates 32 are joined to the spacer plate 34 and each other by means of pins 36. Alternatively, the cheek plates can be riveted, welded or otherwise joined to the spacer plate 34.

Referring to FIGS. 2–5, it will be seen that the spacer plate 34 comprises a generally U-shaped member and, thus, defines a generally rectangular hollow interior space within the housing 26. The locking mechanism is disposed within this space and generally functions to releasably secure the lower end of the single cuff bow 22 to the lower end of the double cuff bow 20.

Figure 2:
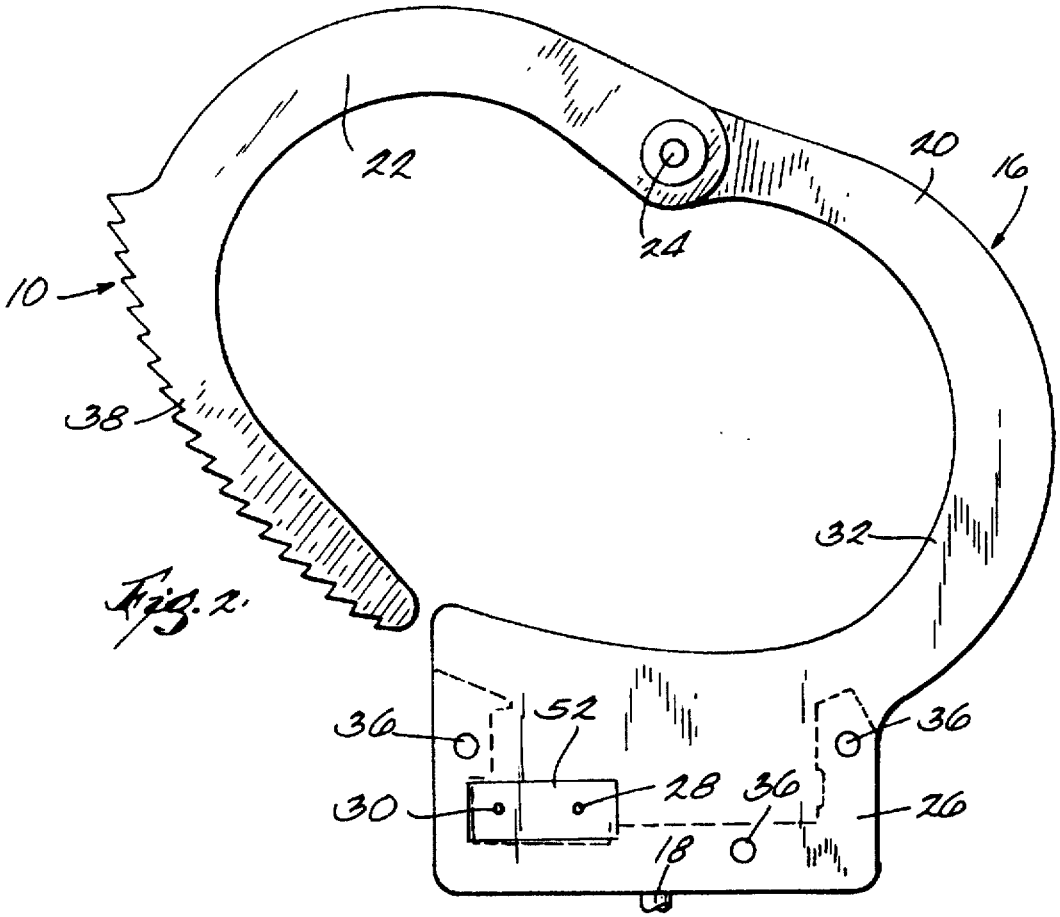
FIG. 2 is a front elevation view of the fluid actuated handcuff shown in FIG. 1, showing the handcuff in an open position.
Figure 3:
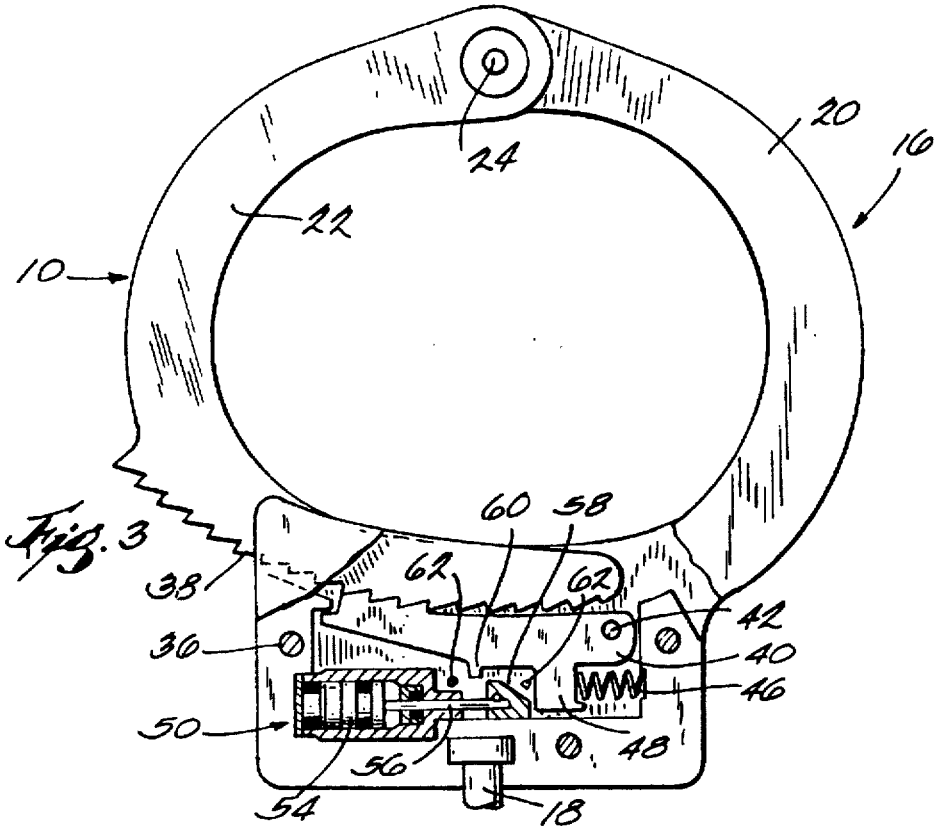
FIG. 3 is a front elevation view, similar to FIG. 2, showing the handcuff in a closed position with an internal, fluid-actuated locking mechanism in a "single lock" position.

As shown in FIGS. 2 and 3, the outer edge of the lower end of the single cuff bow 22 includes a ratchet 38 comprising a plurality of inclined teeth. The locking mechanism includes a pawl member 40 that is mounted within the housing 26 for movement around a pivot 42. The pawl 40 is pivotable toward and away from the ratchet 38 and includes, at its upper end, a plurality of complementary teeth 44 adapted to engage the teeth of the ratchet 38 to resist withdrawing movement of the single bow 22 relative to the housing 26. A spring 46 biases the pawl 40 around the pivot 42 and toward the single bow 22 so that the pawl 40 and ratchet 38 automatically engage as the single bow 22 is inserted into the housing. Preferably, the teeth of the ratchet 38 and the teeth 44 of the pawl 40 are ramped as shown so that they can slide past each other in a ratcheting manner as the single bow 22 is inserted into the housing 26. A downwardly depending leg 48 integrally formed on the pawl 40 engages one end of the spring 46 while the vertical face of the spacer plate 34 engages the other.

Figure 7:
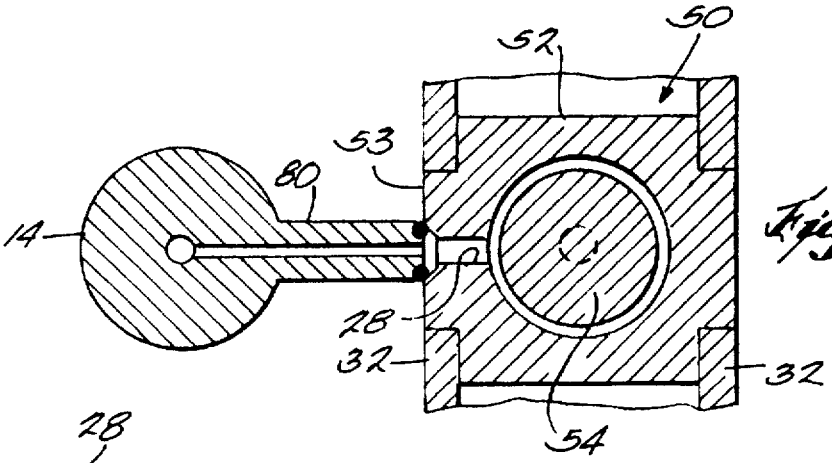
FIG. 7 is a cross sectional view showing the release device being used to unlock the fluid-actuated handcuffs.

In accordance with one aspect of the invention, the locking mechanism includes a fluid actuator 50 for selectively releasing the pawl 40. In the illustrated embodiment, the fluid actuator 50 takes the form of a double acting pneumatic cylinder mounted horizontally within the housing 26. The actuator 50 includes a square or rectangular sectioned housing 52 having a cylindrical bore and a piston 54 reciprocable within the bore. A rectangularly shaped face 53 on each side of the housing projects through a complementary-shaped aperture formed in each cheek plate 32 to secure the actuator 50 between the cheek plates 32. A piston rod 56 coupled to the piston 54 extends horizontally from the housing 52 toward the pawl 40. The piston rod 56 terminates in a block 58 adapted to engage the leg 48 of the pawl 40 when the rod 56 is extended. Pressurized air or other fluid can be applied to either side of the piston through the inlet ports 28, 30 which communicate through the face 53 as best seen in FIG. 7. Pressure applied to inlet port 28 drives the piston 54 to the left as viewed in FIGS. 3–5, while pressure applied to inlet port 30 drives the piston to the right.

Figure 4:
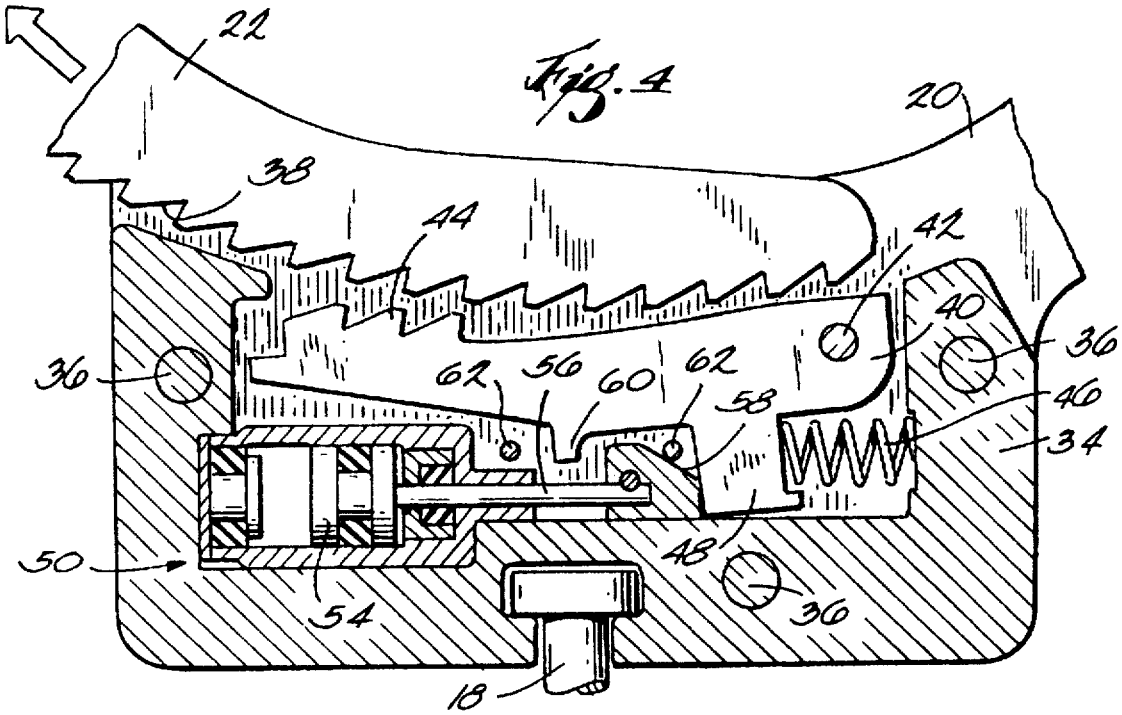
FIG. 4 is a front elevation view, similar to FIG. 3, showing the fluid-actuated locking mechanism in a "release" position.

When pressure is applied to inlet port, 30, the locking mechanism assumes the "release" position shown in FIG. 4. In this position, the piston 54 is driven by the pressure toward the right, thereby extending the piston rod 56 and pushing the block 58 against the pawl leg 48. The force developed by the piston 54 pivots the pawl 40 away from the lower end of the single cuff bow 22 against the resistance of the spring 46. This has the effect of releasing the ratchet 38 and pawl 40 to allow withdrawal of the single bow 22.

When pressure at the inlet port 30 is removed, the force of the spring 46 pivots the pawl 40 back upwardly toward and into engagement with the ratchet 38. As no pressure is applied to the piston 54, the piston is free to move toward the left under the force of the spring 46. However, once the pawl 40 engages the ratchet 38, it stops moving, and the piston 54, piston rod 56 and block 58 stop substantially in the "single lock" position shown in FIG. 3.

Figure 5:
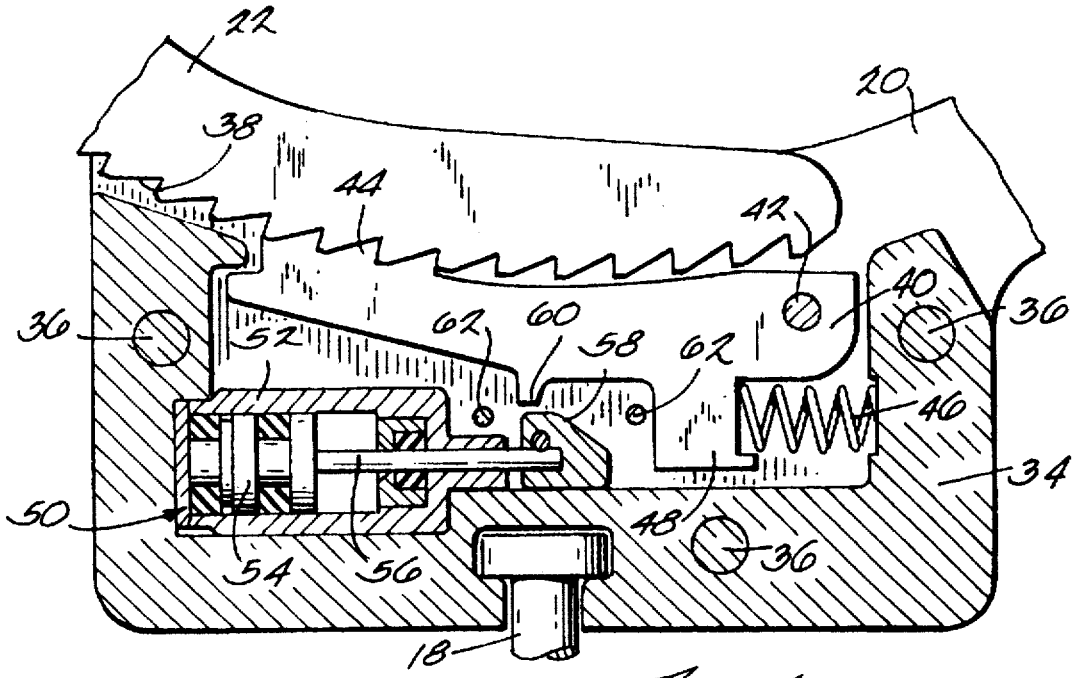
FIG. 5 is a front elevation view, similar to FIG. 4, showing the fluid-actuated locking mechanism in a "double lock" position.

When pressure is applied to the inlet port 28, the locking mechanism is placed into the "double lock" position shown in FIG. 5. In this position, fluid pressure applied to inlet port 28 is applied to the right hand side of the housing 52 thereby driving the piston 54 toward the left as viewed in FIG. 5. This has the effect of placing the block 58 under a tab 60 projecting downwardly from the underside of the pawl 40. The height of the block 58 and the length of the tab 60 are set so that, when the pawl 40 engages the ratchet 38, there is just enough clearance under the tab 60 to let the block 58 fit thereunder. When so positioned, the block 58 prevents the pawl 40 from pivoting away from the ratchet 38. This locks the single bow 22 in position, keeping it from moving in either direction relative to the pawl 40 and housing 26.

By placing the locking mechanism in the "double lock" position, the pawl 40 is prevented from moving away from the ratchet 38. Accordingly, an attempt to defeat the handcuffs by inserting a shim or pick between the ratchet 38 and pawl 40 will be ineffective. Handcuff security is further enhanced by means of a plurality of anti-picking pins 62 mounted in the housing adjacent the block 58. The anti-picking pins get in the way of picking tools that might be introduced into the housing 26 in an unauthorized attempt to defeat the handcuffs by displacing the block from the "full lock" position. Preferably, the inlet ports 28, 30 are made small to further avoid picking attempts. Because compressed fluid is used to actuate the locking mechanism, the openings into the housing 26 can be made much smaller than in devices that use a mechanical key. Finally, because specialized release devices are required in order to unlock the handcuffs, prisoners are less likely to have such devices available to them than is the case when standard, key-actuated handcuffs are used. Security and officer safety are thereby improved.

Figure 6:
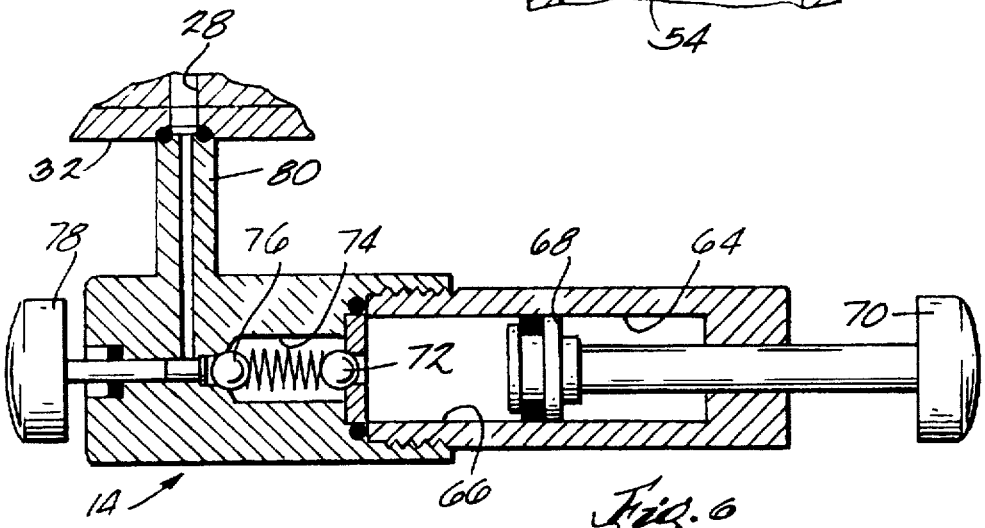
FIG. 6 is a cross sectional view of one embodiment of a release device for unlocking the fluid-actuated handcuffs, useful in understanding the construction and operation thereof.

One example of a release device 14 is shown in FIG. 6. The device provides a hand-operated unit that can be used to release the handcuffs 12 "in the field." As illustrated in FIG. 6, the release device comprises a cylinder housing 64 having a first interior bore 66 and a piston 68 within the bore 66. A handle 70 coupled to the piston 68 extends from the housing 64 and can be used to move the piston 68 and thereby compress air in the bore 66. Air compressed in the bore 66 passes through a ball-type check valve 72 into a second interior chamber 74 having another ball-type check valve 76 at its opposite end. Once in the second chamber 74, the check valves 72, 76 "trap" the compressed air in the second chamber 74. A release button 78 at the forward end of the housing is operable, when pushed, to open the check valve 76 and thereby allow the compressed air in the second chamber 74 to escape through a discharge tube 80. The discharge tube 80 can be placed over either one of the inlet ports 28, 30 as shown in FIG. 7 to actuate the locking mechanism. In use, the handle 70 is stroked to compress air into the second chamber 74 and thereby "charge" the release device. The discharge tube is then placed over the appropriate inlet port, after which the release button is pushed to discharge compressed air into the locking mechanism.

Although the invention has been shown and described in the context of a pair of handcuffs, it will be appreciated that the concept can also be used in other types of restraints, such as legcuffs, as well. In addition, a variety of fluid actuated actuators can be used to operate the locking mechanism beyond the specific embodiment described herein. Furthermore, although compressed air is the preferred fluid used to operate the actuator, it will be appreciated that other gases or liquids can effectively be use as well.

While a particular embodiment of the invention has been shown and described, it will be obvious to those skilled in the art that changes and modifications can be made without departing from the invention in its broader aspects, and, therefore, the aim in the appended claims is to cover all such changes and modifications as fall within the true spirit and scope of the invention.

I claim:

1. A handcuff comprising:

a cuff assembly shaped and dimensioned to encircle a human wrist and movable between an open position and a variable closed position, and a fluid-actuated locking mechanism operatively associated with the cuff assembly operable to lock the cuff assembly in the closed position and to unlock the cuff assembly for movement to the open position.

2. A handcuff as defined in claim 1 wherein the fluid-actuated locking mechanism unlocks the cuff assembly in response to application of pressurized fluid.

3. A handcuff as defined in claim 2 wherein the fluid-actuated locking mechanism locks the cuff assembly when the pressurized fluid is no longer applied.

4. A handcuff as defined in claim 1 wherein the fluid-actuated locking mechanism includes a pair of fluid inlet ports and wherein the fluid-actuated locking mechanism unlocks the cuff assembly in response to the application of pressurized fluid to one of the fluid inlet ports.

5. A handcuff as defined in claim 4 wherein the fluid-actuated locking mechanism locks the cuff assembly when the pressurized fluid is no longer applied to the one fluid inlet port.

6. A handcuff as defined in claim 5 wherein the fluid-actuated locking mechanism is further operable to provide a double lock function in response to the application of pressurized fluid.

7. A handcuff as defined in claim 6 wherein the fluid-actuated locking mechanism provides the double lock function in response to the application of pressurized fluid to the other of the fluid inlet ports.

8. A fluid actuated handcuff comprising:

a cuff assembly including a pair of bows shaped and dimensioned to encircle a human wrist and movable relative to each other so as to facilitate placement around a human wrist, a locking mechanism associated with one of the bows operable to engage and selectively retain the other of the bows in a closed loop configuration of variable dimension so as to fit snugly around a human wrist, and an actuator coupled to the locking mechanism operable to release the locking mechanism and thereby permit disengaging movement of the bows relative to each other, the actuator being operable through the application of a pressurized fluid to the actuator.

9. A handcuff as defined in claim 8 wherein the locking mechanism includes a pawl that is movable into and out of engagement with the other of the bows.

10. A handcuff as defined in claim 9 wherein the actuator operates to move the pawl out of engagement with the other of the bows.

11. A handcuff as defined in claim 10 wherein the pawl is biased into engagement with the other of the bows under a bias force and the actuator functions to move the pawl out of engagement with the other of the bows against the bias force.

12. A handcuff as defined in claim 11 wherein the other of the bows includes a plurality of teeth and wherein the pawl includes a plurality of complementary teeth shaped and dimensioned to engage the teeth of the other of the bows.

13. A handcuff as defined in claim 8 wherein the actuator includes a piston movable within a housing.

14. A handcuff as defined in claim 13 wherein the actuator comprises a double acting cylinder.

15. A handcuff as defined in claim 14 wherein the double acting cylinder is operated by means of pressurized gas.

16. A fluid-actuated handcuff comprising:

a first arcuate cuff bow having an upper end and a lower end defining a lock mechanism housing, a second arcuate cuff bow having an upper end pivotally joined to the upper end of the first cuff bow and having a lower end movable into the lock mechanism housing, a pawl in the lock mechanism housing mounted for movement toward and away from engagement with the lower end of the second cuff bow, a bias member coupled to the pawl for biasing the pawl toward from the lower end of the second cuff bow, a pawl block within the lock mechanism housing movable among a release position wherein the pawl block displaces the pawl away from the lower end of the second cuff bow against the bias of the bias member, a single lock position wherein the pawl is biased by the bias member into engagement with the lower end of the second cuff bow but is free to move away from the lower end of the second cuff bow, and a double lock position wherein the pawl is in engagement with the lower end of the second cuff bow and the pawl block blocks movement of the pawl away from the lower end of the second cuff bow, and a fluid actuator within the lock mechanism housing and coupled to the pawl block operable to move the pawl block among the release, single lock and double lock positions.

17. A fluid-actuated handcuff as defined in claim 16 wherein the fluid actuator comprises a piston movable within a cylinder.

18. A fluid-actuated handcuff as defined in claim 17 wherein the fluid actuator comprises a double acting cylinder.

19. A fluid-actuated handcuff as defined in claim 18 wherein the fluid actuator is actuated by means of pressurized gas.

20. A fluid-actuated handcuff as defined in claim 19 wherein the pressurized gas is communicated to and from the double acting cylinder through a pair of fluid passageways through the lock mechanism housing.

21. A fluid-actuated restraint comprising, a cuff assembly shaped and dimensioned to encircle a human limb and movable between an open position and a variable closed position, and a fluid-actuated locking mechanism operatively associated with the cuff assembly operable to lock the cuff assembly in the closed position and to unlock the cuff assembly for movement to the open position.

22. A fluid-actuated restraint system comprising, a cuff assembly shaped and dimensioned to encircle a human limb and movable between an open position and a variable closed position, a fluid-actuated locking mechanism operatively associated with the cuff assembly operable to lock the cuff assembly in the closed position and to unlock the cuff assembly for movement to the open position, and a release device operable to apply pressurized fluid to the locking mechanism to unlock the cuff assembly.

* * * * *